United States Patent [19]

Nathe

[11] 4,121,314

[45] Oct. 24, 1978

[54] COLLAPSIBLE BRUSH

[76] Inventor: Marcus A. Nathe, P.O. Box 854, Kailua, Oahu, Hi. 96734

[21] Appl. No.: 787,476

[22] Filed: Apr. 14, 1977

[51] Int. Cl.[2] ..... A46B 9/10

[52] U.S. Cl. ..... 15/203; 15/159 A; 132/129

[58] Field of Search ..... 15/159 A, 160, 186–188, 15/201–203, 191–193, 184–185; 132/119–123, 85, 103, 129

[56] References Cited

U.S. PATENT DOCUMENTS

| | | | |
|---|---|---|---|
| 396,289 | 1/1889 | Porter | 15/186 |
| 1,672,468 | 6/1928 | Oshman et al. | 132/103 |
| 1,757,999 | 5/1930 | Hagen | 132/121 X |
| 4,057,868 | 11/1977 | Latham | 15/203 |

*Primary Examiner*—Peter Feldman

*Attorney, Agent, or Firm*—Hane, Roberts, Spiecens & Cohen

[57] ABSTRACT

A collapsible brush is provided with bristle members having bristles of varying length so that a curved top surface is provided to aid in the brushing of a woman's hair. Also provided is an extension which receives in sliding relationship a sliding handle for holding the collapsible brush. A cover when slid into a tracked recess engages the handle to propell it to an extended position. The sliding handle is provided on its lower surface with a mirror which is visible through an opening formed in the bottom wall of the extension when the sliding handle is in its inward or retracted position.

7 Claims, 9 Drawing Figures

COLLAPSIBLE BRUSH

BACKGROUND OF THE INVENTION

The present invention is directed to a collapsible brush, of the kind disclosed in U.S. Pat. No. 2,774,096. In that patent, a plurality of bristle members are provided and are rotatably mounted in a housing. The bristle members, which are comprised of a plurality of uniform length bristles are rotated in response to the movement of a cover member which is slidable in first and second grooves formed in the side surfaces of the housing. As the cover member is slid along the first grooves the bristle members are rotated to an extended position at right angles to the bottom surface of the housing so that the brush may be used for brushing one's hair, brushing one's clothes, etc. When the cover member is removed from the first grooves, the bristle member are rotated into their retracted positions where they lie completely within the housing. In this retracted position, the cover member is then slid into the second grooves and serves the function also of closing off the housing so that a neat receptacle is provided for ease of carrying.

However, it has been found that the collapsible brush of the prior art has not proven suitable for adequate functioning in brushing a woman's hair, or the long hair of a man. Further, it has also been found that such prior art brushes have been difficult to hold.

SUMMARY OF THE INVENTION

It is, therefore, the primary object of the present invention to provide an improved collapsible brush which is designed for special use for longer hair.

Another object of the present invention is to provide a collapsible brush which is easy to handle and to hold, as well as one that is easy to manufacture and cheap to produce.

To this end, the collapsible brush of the present invention has, in addition to the conventional structure shown in U.S. Pat. No. 2,774,096, curved upper surfaces formed by the bristles of the bristle members of the brush. According to the invention, the bristles are of different lengths such that the closer each bristle is to the side surfaces of the housing the shorter are the bristles in length. Further, as the bristles approach the side surfaces of the housing, their angular orientation relative to the centermost bristle increases so as to form the curved upper surface, which allows for the curling of a woman's hair or any long hair during brushing.

The present invention is also provided with a channel extension which receives therein a sliding handle moveable between a retracted position within the channel extension and an extended position out of the channel extension. The cover member is provided with a tab to engage the handle and drive it to the extended position. The sliding handle is provided with a mirror on its lower surface which is still visible when the sliding handle is in its retracted position via an enlarged opening formed in the bottom wall of the channel extension. A tab is also provided to limit the movement of the sliding handle into the channel extension, and to also allow for an easy gripping of the handle when it is to be extended outwardly. Means for preventing the complete removal of the sliding handle from the channel extension may also be provided.

BRIEF DESCRIPTION OF THE DRAWING

The invention will be more readily understood with reference to the following detailed description, when taken in conjunction with the accompanying drawing, wherein.

DETAILED DESCRIPTION OF THE INVENTION

Figure 1:
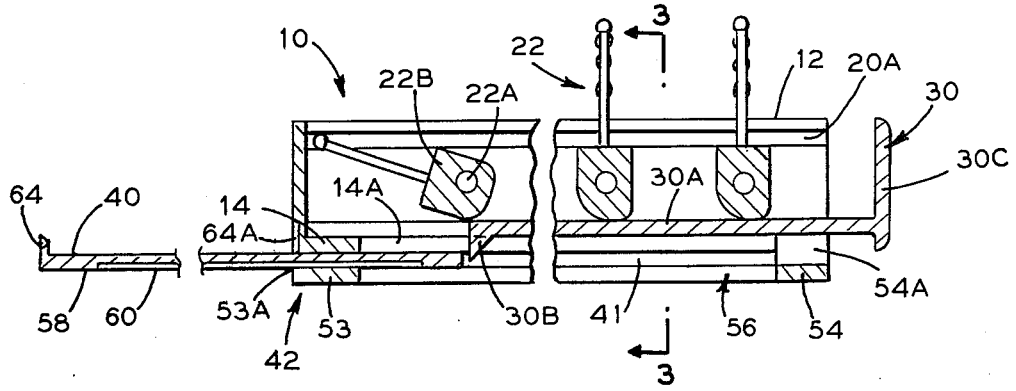
FIG. 1 is a sectional side view along line 1 — 1 of FIG. 3, showing the improved collapsible brush of the invention.

Referring now to the drawing, there is shown the improved collapsible brush of the present invention. The collapsible brush 10 has a housing 12 which is similar to that disclosed in U.S. Pat. No. 2,774,096. A bottom surface 14 forms, along with side surfaces 18 and 20, a receptacle in which are rotatably mounted a plurality of bristle members 22. In the drawing, three such bristle members are shown, although it is to be understood that a different number may be provided. The bristle members 22 are rotatably mounted by axles 22A in cross members 22B in the side surfaces 18 and 20 of the housing in the manner disclosed in the above-cited patent. A cover member 30, also disclosed in the cited patent, serves to not only raise and lower the bristle members 22 but also to close off the housing when the brush is not in use.

Figure 2:
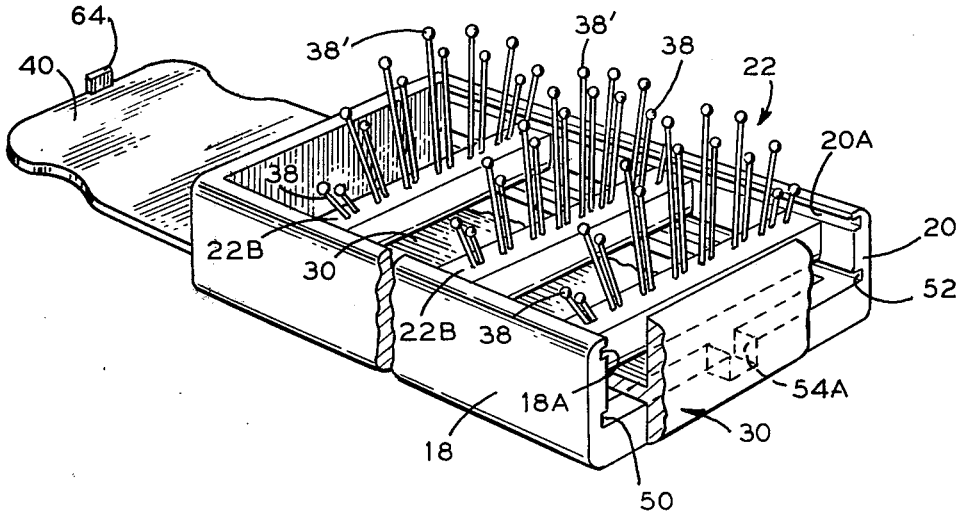
FIG. 2 is a perspective view of the collapsible brush of the invention.
Figure 3:
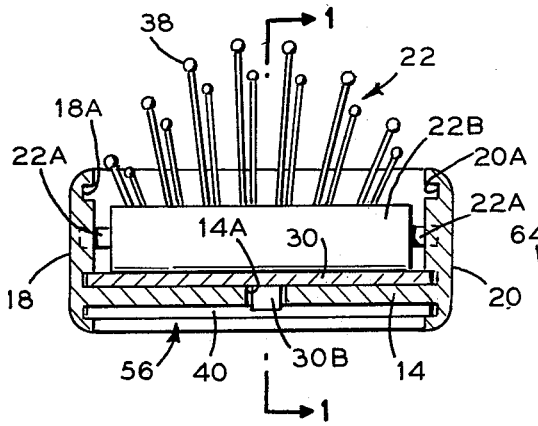
FIG. 3 is a sectional view taken along line 3 — 3 of FIG. 1, showing the channel extension for the sliding handle of the invention.

As mentioned, all of the above elements are well-known in the art, as shown by U.S. Pat. No. 2,774,096. However, in order to better use the brush 10 for its intended purpose, the present invention has provided the bristles of bristle member 22 such that a curved upper surface is presented as shown in FIGS. 2 and 3. The curved upper surface is attained by making the bristles 38 of shorter length the closer they are to the side surfaces 18 and 20, and by orientating the bristles such that the planes containing the bristles other than the centermost bristle 38' are positioned at an angle relative to the plane containing the centermost bristle, as can be readily seen in FIG. 2. The curved upper surface formed by the bristles 38 are particularly suited for the combing of a woman's hair since the curvature allows for curling of the ends of the hair. As the brush is rotated during the brushing of a woman's hair, the hair will be forced to take on a curvature similar to that of the curved upper surface of the bristle elements.

The collapsible brush 10 of the present invention is also provided with a sliding handle 40 which offers ease in handling the brush. The sliding handle 40 is received in a channel or slot 41 formed by an extension 42 connected to the bottom surface 14 of the housing. The extension 42 has one end wall 53 attached to the surface 14, another end wall 54 attached to the bottom surface 14 at the end thereof which is adjacent to the open end of the housing. The end walls are provided on their inner surfaces with grooves 50 and 52.

The end wall 53 of the extension is open at 53A for entrance to the channel. The end and side walls form an enlarged rectangular opening 56.

Figure 4:
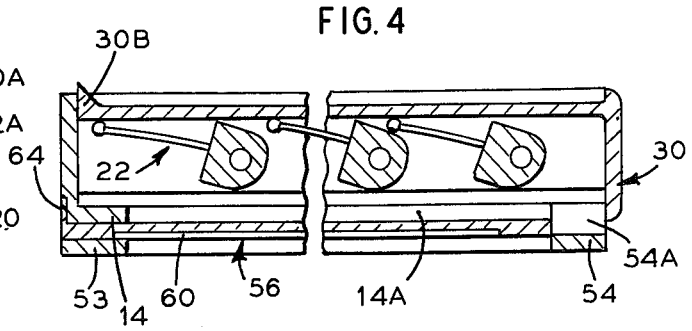
FIG. 4 is a side view, in cross-section, similar to FIG. 1 but with the brush shown in its retracted position.
Figure 5:
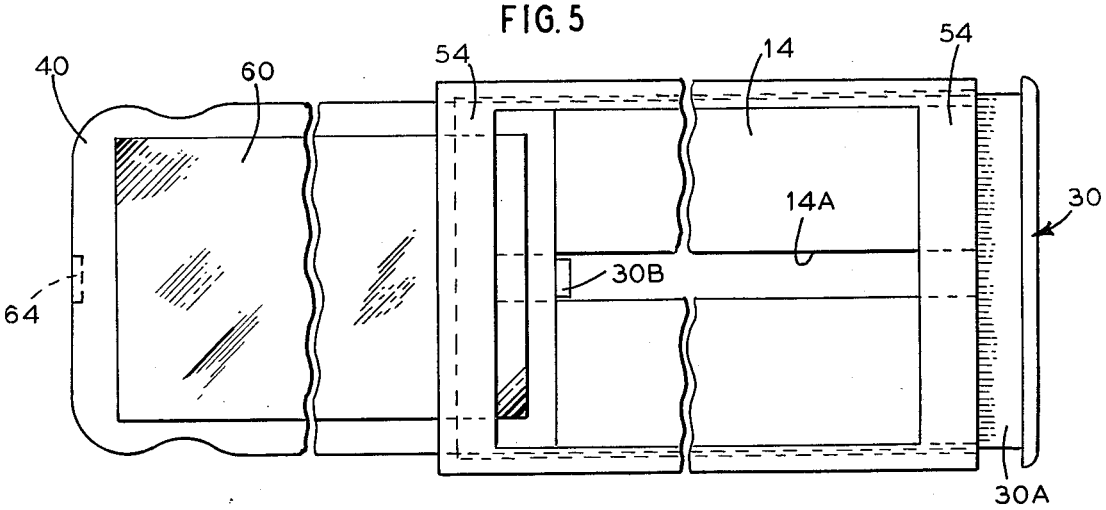
FIG. 5 is a bottom view (reduced in size) showing the sliding cover partially inserted and with the mirror partially extending, showing through the opening of the extension of the collapsible brush of the invention.
Figure 6:
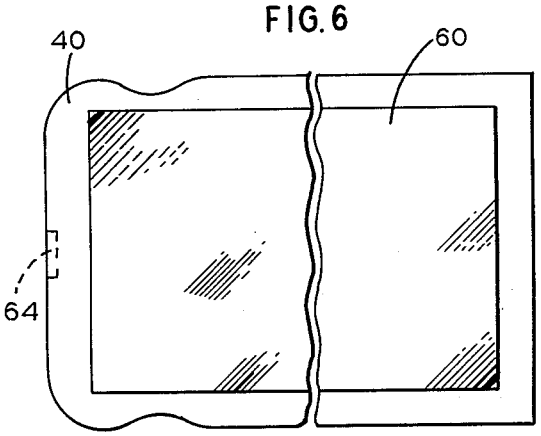
FIG. 6 is a bottom view of the mirror apart from the case.
Figure 7:
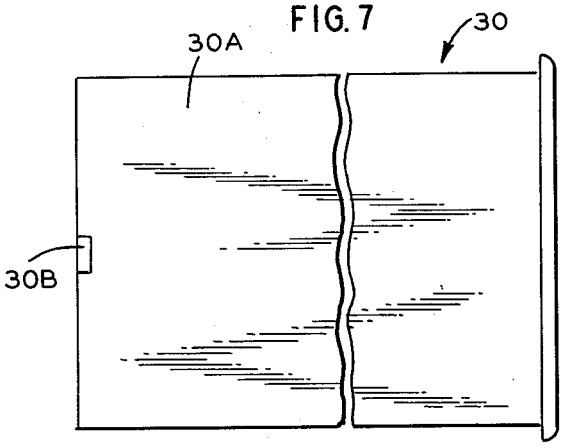
FIG. 7 is a bottom view of the actuating cover showing the projection to slide the mirror/handle combination.
Figure 8:
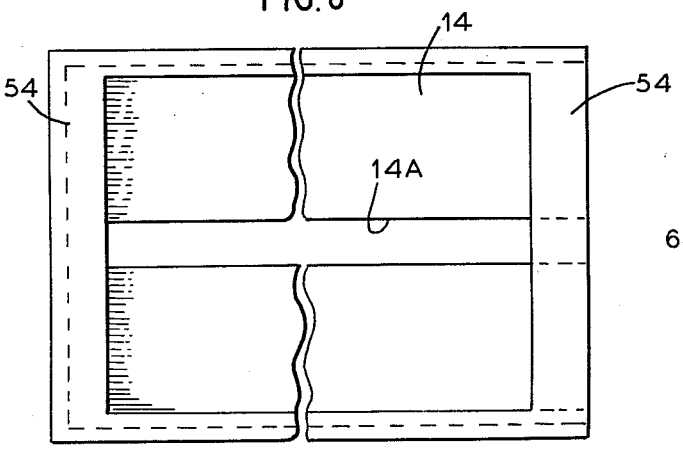
FIG. 8 is a bottom view of the slotted body.

The cover 30 is provided with a planar member 30A having at the end remote from the wall member 30C, a tab 30B. As shown in FIG. 3 when the cover 30 is in the activating position the planar member is accepted by grooves 50 and 52 while the tab 30B first passes through the notch 54A in end wall 54 and then in groove 14A. Thus when the cover is inderted as shown in FIG. 1 the tab 30B propels handle 40 to its extended position. The handle 40 is also provided on its lower surface 58 with a mirror 60 also of rectangular shape. Thus, when the sliding handle 40 is pushed inwardly to its retracted position or when the handle is in its outward extended position, the mirror 60 may be used. When the handle is in its outward extended position shown in FIG. 5, the bottom surface 14 of the housing may be seen through the opening 56 which may be provided with advertising, identification marks, or other writing. The handle may also be provided with a tab 64 which prevents the entry of the handle end into the channel by abutting against the bottom wall 54, as can be seen in FIG. 4.

Figure 9:
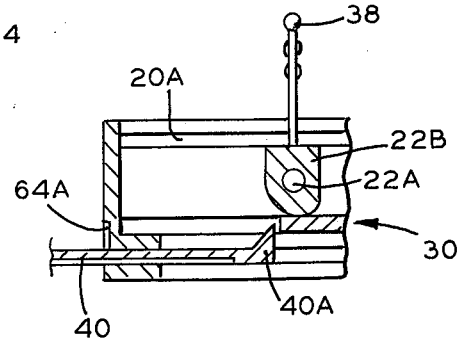
FIG. 9 is a fragmentary alternate view of the projection to operate the sliding mirror/handle combination.

FIG. 9 shows an alternate embodiment of the interengagement of the cover 30 and the handle 40. In particular the tab 30B of the cover 30 is removed. Instead the remote end of mirror 40 is provided with tab 40A. This embodiment has the advantage that the handle cannot be removed.

The housing and extension may be made of plastic and molded integrally together. The bristles 38 preferably have the shape and orientation as shown.

While a specific embodiment of the invention has been shown and described, it is to be understood that numerous changes and modifications may be made without departing from the scope and spirit of the invention.

What is claimed is:

1. In a collapsible brush comprising a housing having a bottom surface, a first and second side surface extending upwardly from said bottom surface at the edges thereof, and a cover member, each of said first and second side surfaces having a first groove and a second groove formed therein facing toward the other side surface, said first groove being spaced from said second groove and positioned near said bottom surface, each of said first and second grooves extending approximately the length of said side surfaces so that said cover member may be slid alternatively through said first grooves or said second grooves, said housing further comprising an open end for the reception therethrough of said cover member and a closed end connecting said first and second side surfaces together at one end thereof, and a plurality of brush members, each of said plurality of brush members being rotatably mounted in said housing and rotated in response to movement of said cover member in said first grooves, each brush member having a plurality of bristles which protrude outwardly of said housing when said cover member is inserted in said first grooves and which are contained within said housing when said slide member is in said second grooves, wherein the improvement comprises: said bristles for each of said plurality of bristle members forming a curved outer combing surface, said curved outer combing surface being formed such that the length of each of said plurality of bristles is shorter the closer it is to one of said first and second side surfaces; and handle means, said handle means comprising a sliding handle, means attached to said bottom surface of said housing for slidably receiving said sliding handle therein for alternate extension and retraction therefrom, said means for slidably receiving said sliding handle comprising an extension having an end wall attached to said bottom surface at one end thereof near said open end of said housing, first and second side walls also attached to said bottom surface, and a bottom wall extending at right angles to said end wall, parallel to and spaced from said bottom surface so that a channel opening is formed between said bottom wall and said bottom surface for the reception therein of said sliding handle and interengaging means between said sliding handle and said cover member whereby when said cover member is inserted in said first groove said sliding handle is propelled to an extended position.

2. The improvement according to claim 1, wherein the centermost one of said plurality of bristles lies in plane, and each of the other of said plurality of bristles also lying in a plane which is oriented at an angle relative to said plane containing said centermost bristles, the planes containing the other bristles extending at a greater angle relative to said plane containing said centermost bristle the greater the distance from said centermost bristle in a direction toward each of said first and second side surfaces.

3. The improvement according to claim 1, wherein said bottom wall comprises an opening formed therethrough, so that said bottom surface of said housing may be seen through said opening when said sliding handle is in its extended operating position.

4. The improvement according to claim 3, wherein said sliding handle comprises an upper surface and a lower surface, said surface being in contact with said bottom wall when said sliding handle is in its retracted position, said lower surface having mounted thereon a mirror approximately of the same shape as said opening, so that said mirror may be viewed via said opening when said sliding handle is in its retracted position and may also be viewed when said sliding handle is in its extended position.

5. The improvement according to claim 4, wherein said sliding handle further comprises a tab mounted on the forward portion thereof furthest from said end wall, said tab extending perpendicularly to said portion of said sliding handle so that when said sliding handle is pushed inwardly to its retracted position the tab strikes against the end of said bottom wall remote from said end wall to thereby limit the movement of said sliding handle and to allow for the grasping thereof to slide outward said sliding handle to its extended position.

6. The improvement according to claim 4, wherein said sliding handle comprises preventing means for preventing the removal of said sliding handle from said opening when moved outwardly to its extended position, said means being positioned on said sliding handle at its end nearest said end wall.

7. The improvement according to claim 6 wherein said preventing means comprises a tab on the end of said sliding handle within said extension, said tab also being engageable by said cover member.

* * * * *